US007735847B2

(12) United States Patent
Dougherty

(10) Patent No.: US 7,735,847 B2
(45) Date of Patent: Jun. 15, 2010

(54) ALL TERRAIN ADAPTER FOR A WHEELCHAIR

(76) Inventor: Patrick S. Dougherty, 5449 N. Cattail Way, Boise, ID (US) 83714

( * ) Notice: Subject to any disclaimer, the term of this patent is extended or adjusted under 35 U.S.C. 154(b) by 353 days.

(21) Appl. No.: 11/820,632

(22) Filed: Jun. 19, 2007

(65) Prior Publication Data

US 2008/0315549 A1 Dec. 25, 2008

(51) Int. Cl.
*A61G 5/10* (2006.01)

(52) U.S. Cl. ..... 280/304.1; 280/767

(58) Field of Classification Search ..... 280/767, 280/7.1, 7.15, 47.17, 47.18, 47.2, 47.25, 280/47.34, 242.1, 250, 250.1, 278, 287, 293, 280/295, 296, 304.1, 647, 763.1, 764.1; 269/228, 236, 32; 180/907

See application file for complete search history.

(56) References Cited

U.S. PATENT DOCUMENTS 2,649,309 A * 8/1953 Deissner ..... 280/42
3,485,508 A * 12/1969 Hudnall ..... 280/234
3,485,510 A * 12/1969 Merlan ..... 280/250
4,132,423 A 1/1979 Chant
4,141,566 A 2/1979 Benes
4,316,616 A * 2/1982 Boivin ..... 280/304.1
4,471,972 A * 9/1984 Young ..... 280/304.1
4,483,548 A * 11/1984 Zirrilo ..... 280/304.1
4,503,925 A * 3/1985 Palmer et al. ..... 180/13
4,720,117 A * 1/1988 Hay ..... 280/250
4,962,942 A * 10/1990 Barnett et al. ..... 280/5.28
5,076,390 A 12/1991 Haskins
5,116,067 A 5/1992 Johnson
5,149,118 A 9/1992 Oxford
5,273,304 A * 12/1993 Berkheimer ..... 280/304.1
5,280,937 A * 1/1994 Needham ..... 280/259
5,312,127 A * 5/1994 Oxford ..... 280/304.1
5,427,398 A 6/1995 Weybrecht
5,494,126 A * 2/1996 Meeker ..... 180/13
5,501,480 A * 3/1996 Ordelman et al. ..... 280/304.1
5,695,204 A * 12/1997 Ford ..... 280/507
5,983,452 A 11/1999 McGovern
6,027,132 A * 2/2000 Robinson et al. ..... 280/250.1
6,669,222 B1 * 12/2003 Barrett et al. ..... 280/304.1

(Continued)

FOREIGN PATENT DOCUMENTS

DE 19724024 A1 * 12/1998

(Continued)

OTHER PUBLICATIONS

EP 184492 A1 Translation from EPO Website.*

(Continued)

*Primary Examiner*—Glenn Dayoan
*Assistant Examiner*—Brodie Follman
(74) *Attorney, Agent, or Firm*—Dergosits & Noah LLP

(57) ABSTRACT

An all terrain adapter for a wheelchair that removably clamps onto the foot support of the wheelchair and supports a relatively large diameter, slightly inclined swivelling nose gear wheel at an extended distance from the foot support to stabilize the wheelchair when it is being pushed over soft or uneven surfaces and which swivels around when the wheelchair is moved forward to lift the front wheels of the wheelchair clear of the ground.

18 Claims, 10 Drawing Sheets

U.S. PATENT DOCUMENTS

| | | | | |
|---|---|---|---|---|
| 6,869,084 | B2 | 3/2005 | Volk et al. | |
| 7,216,728 | B2 * | 5/2007 | Huang et al. | 180/13 |
| 7,229,090 | B2 * | 6/2007 | Cumbie | 280/491.3 |
| 2004/0108147 | A1 * | 6/2004 | Ross | 180/13 |
| 2006/0000664 | A1 * | 1/2006 | Huang et al. | 180/907 |
| 2007/0096427 | A1 * | 5/2007 | Knaub | 280/304.1 |
| 2009/0008902 | A1 * | 1/2009 | Kylstra et al. | 280/304.1 |

FOREIGN PATENT DOCUMENTS

| | | | |
|---|---|---|---|
| EP | 184492 | A1 * | 6/1986 |
| FR | 2841462 | A1 * | 1/2004 |

OTHER PUBLICATIONS

DE 19724024 A1 Translation from EPO Website.*

FR 2841462 A1 Translation from EPO Website.*

Brochure and picture of Spoke 'N Motion for MTC Freedom Wheel model wheelchair adapter.

* cited by examiner

ALL TERRAIN ADAPTER FOR A WHEELCHAIR

FIELD OF THE INVENTION

The present invention relates generally to wheelchairs and more particularly to a terrain adapter for wheelchairs.

BACKGROUND OF THE INVENTION

Conventional, user propelled wheelchairs have a seat frame, relatively large diameter rear wheels, typically from 22 inches to 26 inches, which often have a rim that the user can push to rotate the wheels and thus propel the wheelchair, and a pair of front or caster wheels that are considerably smaller in diameter than the rear or driving wheels, typically between 2 to 10 inches and more commonly 2 to 6 inches. These wheelchairs can also be pushed from behind. However, when an attempt is made to propel or manipulate such wheelchairs on rough terrain or soft terrain, where the vehicle's front wheels either encounter obstructions or sink into the terrain then movement and control of the wheelchair becomes extremely difficult and hazardous. The front wheels can unintentionally be directed in other than the desired direction of movement. Pushing a wheelchair on any surface that is not smooth is both tiring and can be enough to upset the balance of the user or pusher and result in stopping or worse, the user falls out of the wheelchair. This is particularly true for terrain such as sand, snow, ice, and mud, which require extreme strength and physical dexterity to safely propel and guide the wheelchair. Such rough terrain is often unavoidable in daily life situations for a disabled person in a wheelchair. While many of these problems can be overcome simply by increasing the diameter of the front wheels, there are substantial disadvantages to doing so. Compared to small diameter front wheels, the large diameter front wheels are more difficult to propel over normal surfaces which are essentially smooth and hard, are difficult to turn, and allow less clearance for feet positioned on foot plates.

There are known, specialized wheelchairs such as three wheeled sport wheelchairs, some of which are discussed further herein, that can help eliminate some of the above described problems in travelling over rough surfaces, however, typically these wheelchairs are expensive, bulky, and not conveniently suited for travel over smooth, everyday terrain, such as in buildings, homes or the like.

There is a need for a simple, easy to use, easy to install and remove, portable, light weight, low cost, safe, attractive, and durable attachment for wheelchairs to safely and easily negotiate difficult terrain. Such a device should improve handling and personal safety for an individual propelling such wheelchairs, occupants of such wheelchairs, and individuals in the vicinity of such wheelchairs. The device should be capable of use on snow, sand, ice, mud and other terrain, and the like, where wheels ordinarily sink into the terrain, and/or otherwise become directed in a direction other than the desired direction of travel of such wheelchairs, and make wheeled transportation otherwise difficult or impossible, and hazardous, and be easy to use. The device should be of simple construction, easy to manufacture, and easily installable as a retrofit on existing wheelchairs or in new installations during construction and fabrication of such wheelchairs, adjustable and installable for different wheel sizes and on different types of wheelchairs.

Different wheels, skids, skis and other adaptations for wheelchairs have heretofore been known, however, none of these adequately satisfies these aforementioned needs:

U.S. Pat. No. 5,116,067 (Johnson) discloses a wheelchair having a support structure that attaches to standard wheelchair wheels for providing mobility and allowing interchangeability of accessories to change the support structure for sporting events, such as water and snow skiing. The wheelchair has a frame and sockets to replace attachable wheels with water and snow skis.

U.S. Pat. No. 4,141,566 (Banes et al) discloses a sled frame for releasable attachment of a wheelchair. The sled frame has a body portion supporting a pair of laterally spaced, horizontally disposed support members which, in turn, are sized to be disposed between the wheels of a wheelchair to support the frame of the wheelchair on the sled. The support members are each provided with a plurality of locking devices which releasably engage the frame of the wheelchair to securely lock the wheelchair to the sled.

U.S. Pat. No. 5,076,390 (Haskins) discloses a wheelchair having a foldable frame with an interlinked system of parallelogram linkages which can be readily collapsed for travel and to provide access to otherwise restricted areas.

U.S. Pat. No. 5,983,452 (McGovern) discloses wheel and skid for replacement of each front wheel of a wheelchair. Each skid has a saucer-shaped base that expands the contact area of each front wheel to prevent it from sinking into the terrain, and/or otherwise become directed in a direction other than the desired direction of travel. The base has a slot, a wheel assembly having a wheel, the slot having the wheel of the wheel assembly protruding therethrough, and a fastener for fastening the wheel assembly to the wheel skid. This device is not intended to be easily installable and removable when rough terrain is encountered. Instead, it is generally permanently kept on the wheelchair which complicates folding the wheelchair and providing foot spacing on the foot support.

U.S. Pat. No. 5,427,398 (Weybrecht) discloses set of wide auxiliary wheels or wheel extensions so that the wheelchair can be much more easily used off road. An anti-tip over wheel can also be attached to the back of the wheelchair. In general, although these modifications can be added or removed to the wheelchair to adapt it to rough terrain, they generally require the assistance of an abled person, or at least they can not be conveniently added or removed by the user of the wheelchair while he or she is seated in it.

U.S. Pat. No. 4,132,423 (Chant) discloses pivoting rocker shaped struts that attach to the front of a wheelchair to enable the small front wheels of the wheelchair to negotiate sidewalk curbs or the like. The struts can be either permanently attached or removably attached. However useful these devices may be for negotiating curbs or similar obstructions, they are of no great help in soft terrain or over surfaces having holes.

U.S. Pat. No. 6,869,084 (Volk) discloses a wheelchair wherein the front wheels have been replaced by skids. This adaptation is not designed to be easily installable and removable.

A recent innovation is a wheelchair adapter denoted model "Magelan MTC" (ModuleToutChemin) by the French company Magelan and marketed in the USA under the trademark "Freedom Wheel" by a Spokes-'n-Motion of Denver, Colo. This adapter comprises a Y-shaped frame that must first be attached to the front bars of a wheelchair using two grips. A nose gear wheel attached to the front of the frame is thereafter extended downward by the occupant of the wheelchair by turning a hand crank. The diameter of the nose gear wheel is large compared to the diameters of the conventional wheelchair front wheels. As the nose gear wheel is cranked downward, it tilts the wheelchair back and lifts the much smaller front wheels clear of the ground. The relatively large diameter nose gear wheel is able to roll over soft surfaces or uneven surfaces. The device can be quickly attached and detached by the wheelchair occupant, however, it is relatively large and cumbersome and requires horizontally actuated, leftside and rightside clamping devices, thus generally requiring that the wheelchair occupant have the full use of both arms to push the clamping devices closed. Further, the process of lifting the wheelchair front wheels clear of the ground is cumbersome and time consuming.

For the foregoing reasons, there is a need for a simple, easy to use, easy to install and remove, portable, light weight, low cost, safe, attractive, and durable device to facilitate maneuvering of manually propelled wheelchairs on difficult terrain. Such a device should improve handling and personal safety for an individual propelling such wheelchairs, occupants of such wheelchairs, and individuals in the vicinity of such wheelchairs.

The device should be capable of use on snow, sand, ice, mud and other uneven terrain, and the like, where wheels ordinarily sink into the terrain, and/or otherwise become directed in a direction other than the desired direction of travel of such wheelchairs, and make wheeled transportation otherwise difficult or impossible, and hazardous. The device should be of light weight, simple construction, easy to manufacture, easily installable as a retrofit on existing wheelchairs of all sizes and types, and easy to use.

SUMMARY AND OBJECTS OF THE INVENTION

In view of the above-described disadvantages with present systems, it is an object of the embodiments of the present invention to provide an all terrain adapter for a wheelchair.

It is another object of the present invention to provide an adapter for a wheelchair that increases the stability of the wheelchair when traveling over uneven surfaces or soft surfaces.

It is yet another object of the present invention to provide a light weight all terrain adapter for a wheelchair.

It is still another object of the invention to provide an all terrain adapter for a wheelchair that can be easily installed and removed by the occupant of the wheelchair while he or she is seated in the wheelchair and using only one arm.

The above and other objects are achieved by the present invention of an all-terrain adapter for a wheelchair of the type having a seat frame, including a foot support, and large rear wheels and smaller front wheels mounted to the seat frame for allowing the wheelchair to be rolled over a surface. The adapter according to the preferred embodiments of the invention comprises a strut for removable attachment at one end to the foot support, a single nose gear wheel having a diameter that is at least two to three times larger than the diameter of the front wheels, a swivel mount for attaching the nose gear wheel to another end of the strut so that the nose gear wheel swivels about an axis that is slightly inclined from the vertical, and attachment means for attaching and detaching the one end of the strut to the foot support, and wherein the front wheels of the wheelchair are lifted from the surface and remain suspended above the surface by the action of propelling the wheelchair in the forward direction to cause the nose gear wheel to swivel in a direction that shortens the wheelbase of the wheelchair between the nose gear wheel and the rear wheels.

In the preferred embodiments the mechanism for attaching the one end of the strut to the foot support includes a hand operated clamp. In some embodiments, the hand-operated clamp, in clamping the one end of the strut to the foot support, forces the other end of the strut, on which the nose gear wheel is mounted, downward to bring the nose gear wheel in contact with the surface until the foot support and wheelchair are tilted backward, thereby relieving some of the weight of the wheelchair from the front wheels.

In one preferred embodiment, the mechanism for attaching the one end of the strut to the foot support includes a male coupling and a female coupling that attaches the strut to the mechanism for attaching the one end of the strut.

Other features and advantages of the present invention will be apparent from the accompanying drawings and from the detailed description that follows.

BRIEF DESCRIPTION OF THE FIGURES

The present invention is illustrated by way of example and not limitation in the figures of the accompanying drawings, in which like references indicate similar elements, and in which.

DESCRIPTION OF THE PREFERRED EMBODIMENTS

The adapter of the present invention includes a frame that easily attaches to the foot support of the wheelchair and raises the front wheels off the ground as the wheelchair is rolled forward. A slightly canted nose gear wheel attached to the frame extends the wheelbase making the chair more stable pushing over rough surfaces and provides a larger wheel in front to roll over surfaces that would normally upset the wheelchair.

Figure 1:
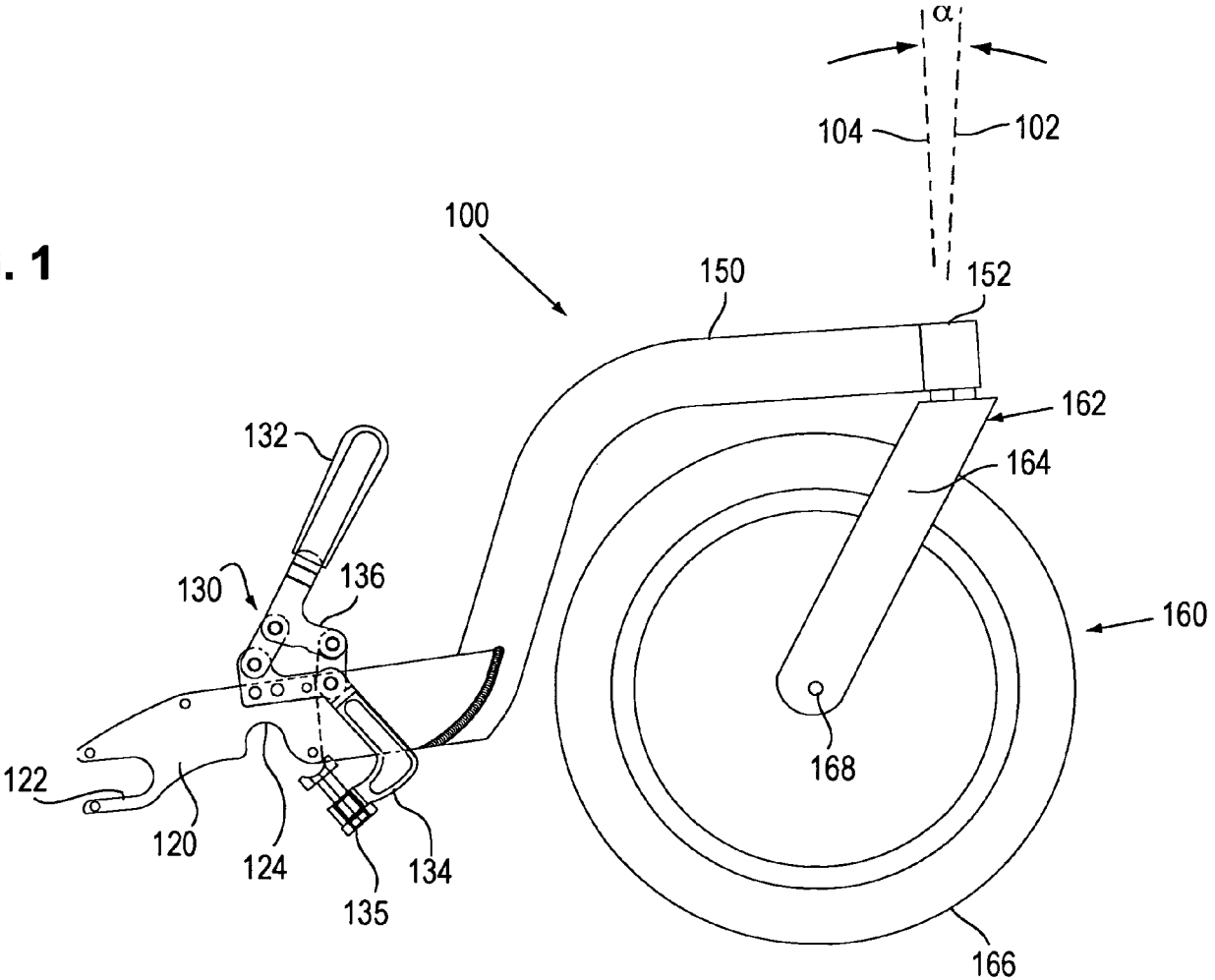
FIG. 1 is a vertical side view of an all terrain adapter for a wheelchair according to a first embodiment of the present invention.
Figure 2:
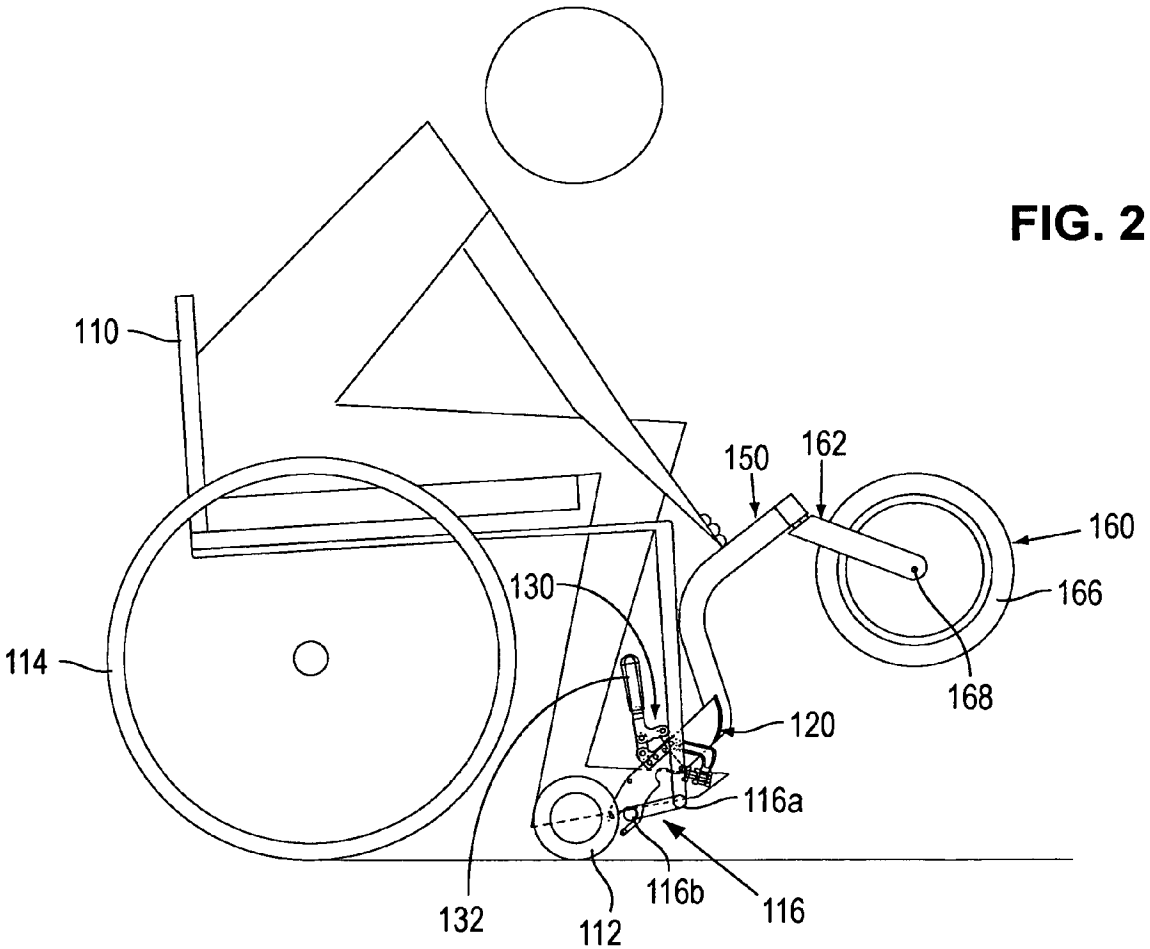
FIGS. 2 and 3 are vertical side views that illustrate the method of attaching the first embodiment of the present invention to a wheelchair.

Referring now to FIGS. 1 and 2, there is shown a first preferred embodiment of the invention comprised of a one piece adapter 100. The adapter 100 attaches to a conventional wheelchair 110 having relatively small front wheels 112, much larger rear wheels 114, and a foot support 116 having a forward bar 116*a* and a rear bar 116*b*. The bars 116*a* and 116*b* are parallel to each other and extend horizontally across the front of the wheelchair frame. The adapter 100 comprises a fixture 120 that has a rectangular cross-section and is provided with a fork opening 122 at one end that engages with the rear bar 116*b* of the wheelchair foot support 116. The fixture 120 also has a downwardly extending notch 124 spaced forward of the fork 122 for engaging with the forward bar 116*a* of the wheelchair foot support 116.

Mounted on the fixture 120 is a hand operated clamp 130 that has a handle 132 and hook 134 and a four bar linkage 136 between the handle 132 and the hook 134. The hook 134 is positioned just beneath the notch 124 and has an adjustable clamping plate 135 that, when the clamp 130 is closed, presses tightly against foot support forward bar 116*a* in the notch 124, locking the fixture 120 onto the wheelchair foot support 116. The clamp 130 can operate other than as shown in the figure, provided that the same clamping action results. In the preferred embodiment the clamp 130 is a pull action, vertical latch clamp manufactured by De-Sta-Co company of Auburn Hills, Mich. By acting in a vertical plane, the wheelchair occupant is better able to use his or her weight in actuating the clamping mechanism, as compared to a horizontal action clamp. Also, the clamp can be actuated with only one arm.

The adapter 100 further comprises an S shaped support or strut 150 that is rigidly attached at one end to the fixture 120 and extends upwardly from it. At the other end of the strut 150 is a swivel mount 152. A nose gear wheel 160 is mounted in a fork 162 for rotation in the swivel mount 152. The swivel mount 152, either due to the angle of attachment of the fixture 120 to the wheelchair 110, the shape of the strut 150, the mounting angle of the swivel mount 152 on the strut 150, or a combination of all of these factors, preferably provides a steering axis 104 that is canted slightly rearwardly from the vertical 102. The angle of this cant defines the caster angle $\alpha$ and is preferably between 5° to 10° from the vertical. A caster angle is defined as the angle that the steering axis makes with the horizontal or vertical, depending on convention. The steering axis 104 is the axis about which the fork 162 pivots. This caster angle could be made to be adjustable by making adjustable the angle of attachment of the fixture 120 to the wheelchair 110, the shape of the strut 150, the mounting angle of the swivel mount 152 on the strut 150, or a combination of all of these.

The nose gear wheel assembly 160 includes the fork 162, that has one end mounted for rotation in the swivel mount 152, and a pair of parallel legs 164 that extend downwardly and slightly rearwardly from the swivel mount 152 (as viewed in FIG. 1) and straddle a wheel 166 that has a relatively large diameter compared to the front wheels 112. In the preferred embodiment, the diameter of the nose gear wheel is between 10" and 16" and is preferably 12". The angle of inclination of the forks 164 is about 27° from the vertical that helps determine a positive trail, which is defined as the horizontal distance from where the steering axis intersects the ground to where the wheel 166 touches the ground. The horizontal trail in the disclosed embodiments is approximately 3". The wheel 166 can include a pneumatic tire and is rotatably mounted about an axle 168 extending between the forks 164.

When the nose gear wheel 160 is traveling in the forward, i.e., the leading direction, the trail of the legs 164 will cause a rotational torque to be exerted on the fork 162 so that it rotates to position itself as shown in FIG. 1 with the wheel axle 168 at its closest point to the wheelchair 110. Taking the distance between the axle of the rear wheels and the axle 168 as the wheelbase of the terrain adapted wheelchair 110, the effect is to minimize this wheelbase. (This is not to be confused with the fact that the terrain adapted wheelchair has a longer wheelbase than the non-adapted conventional wheelchair). When the nose gear wheel 160 is travelling in the opposite direction, i.e., the rearward direction, the position of the fork 162 is rotated 180° from that shown in FIG. 1 so that the axle 168 is moved farther away from the axle of the rear wheels, thereby lengthening the wheelbase of the terrain adapted wheelchair 110. However, because of the caster angle, lengthening the wheelbase has the effect of lowering the foot support 116.

Figure 3:
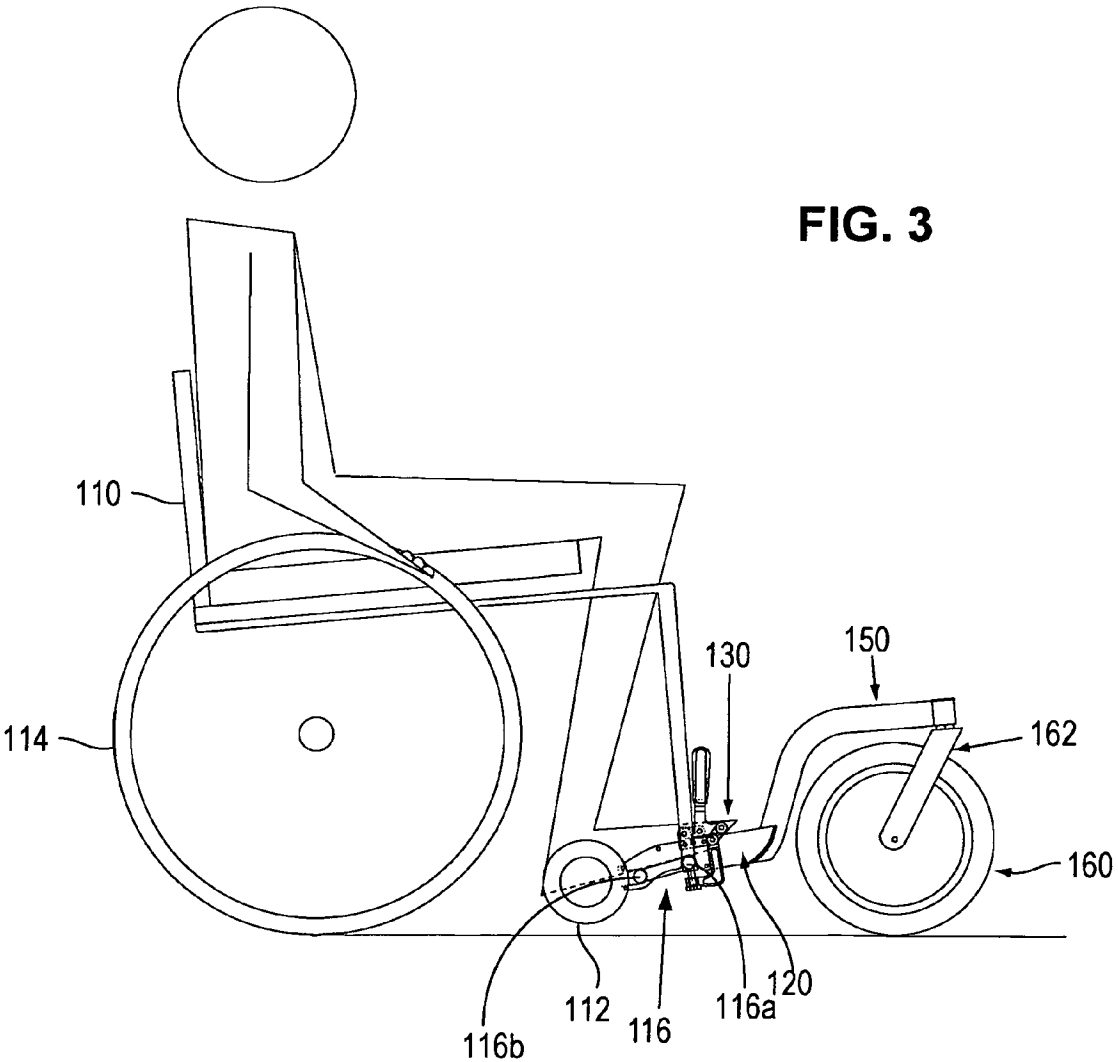
Figure 10:
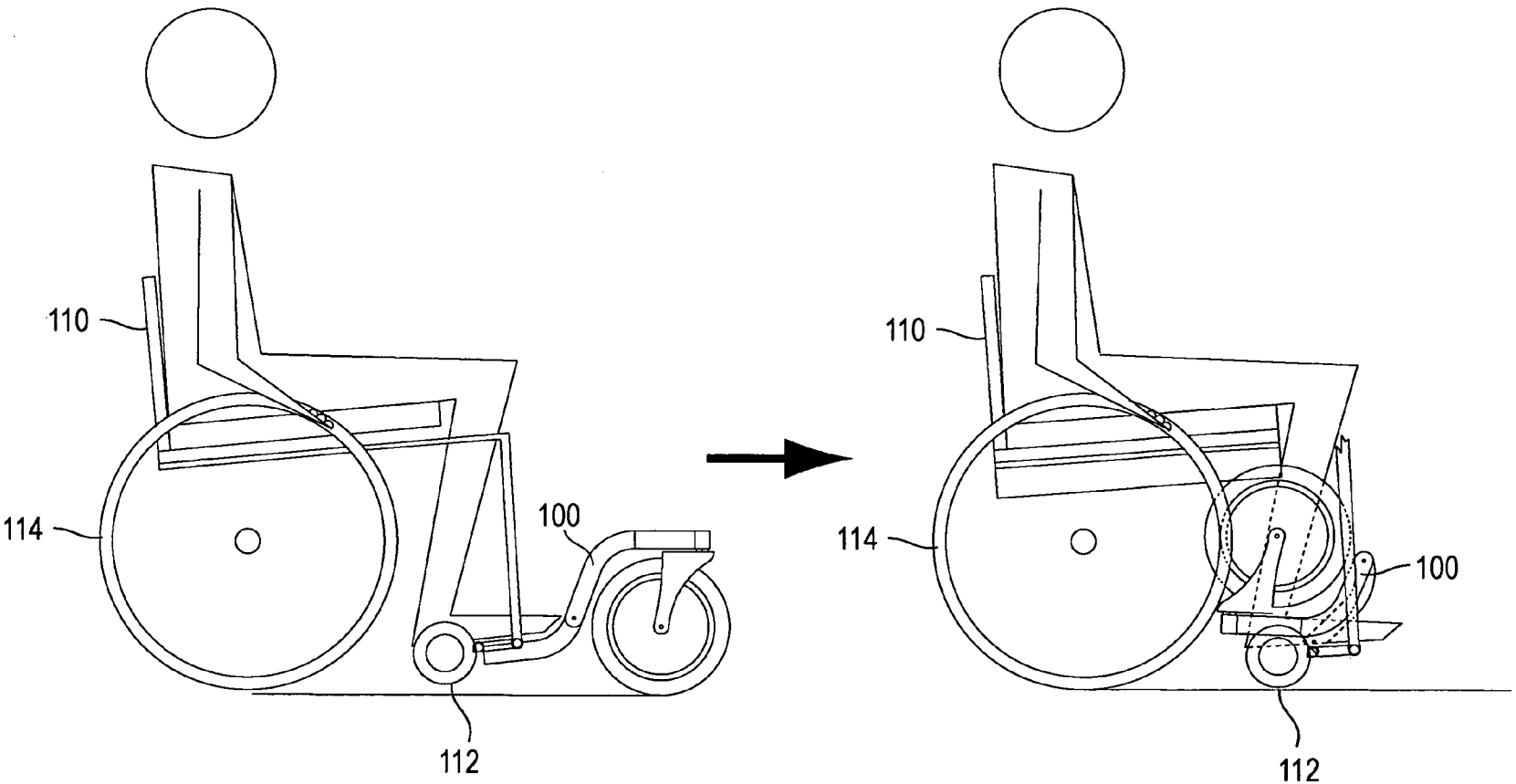
FIG. 10 is a vertical side view of two wheelchairs, each incorporating an adapter of the first embodiment of the invention, illustrating the adapted as deployed and as stowed between the legs of the user of the wheelchair.

Referring now more particularly to FIGS. 2 and 3, to install the adapter 100, the user slides it in-between his or her feet and engages the parallel bars 116*b* and 116*a* of the wheelchair foot support 116 with the fork 122 and notch 124, respectively, on the fixture 120. The adapter 100 is then lowered to the ground with the nose gear wheel 160 swiveled ahead of the support 150, as shown in FIG. 2. The lever 132 is then pulled to cause the hook 134 and clamping plate 135 to clamp against the front bar 116*a* and both secure the adapter 100 to the wheelchair foot support 116 and to slightly lift some of the weight of the wheelchair 110 from the front wheels 112. The lever 132 is an over-center design and locks into the ready position. When the wheelchair 110 is pushed forward, the nose gear wheel 160 swivels 180° so that it trails behind the front end of the support 150, as shown in FIG. 3. As explained above, this shortens the wheelbase of the terrain adapted wheelchair 110 and thereby lifts the front wheels 112 clear of the ground, placing all of the front weight of the wheelchair 110 on the nose gear wheel 160. To remove the adapter 100, the user simply moves wheelchair 110 in the rearward direction to return the nose gear wheel to the rotational position shown in FIG. 2, thereby dropping the front wheels 112 to the ground, moves the lever 132 back to unclamp the adapter 100 from the front bar 116*a*, thereby returning the front weight of the wheelchair 110 to the front wheels 112, and disconnects the adapter 100 from the wheelchair 110. It is the combination of engaging the lever 132 and then moving the wheelchair 110 in the forward direction to swivel the nose gear wheel 160 that makes lifting the front wheels 112 clear of the ground so relatively effortless for the wheelchair user. Alternatively, as illustrated in FIG. 10, the adapter 100 can be left mounted in an up position stowed and locked between the user's legs by means of a latch or other type of fastening (not shown).

It will be noted that when the wheelchair 110 travels in the rearward direction, the nose gear wheel 160 swivels in such a manner to lower the front wheels 112 to the ground or nearly to the ground, however, this is of no concern because the weight of the wheelchair 110 is still primarily apportioned between the rear wheels 114 and the nose gear wheel 160. The rear wheels 114, because of their relatively large diameters, are easily able to roll over obstacles or soft terrain without upsetting the balance of the wheelchair. That is, during rearward travel there is no tendency for the front wheels 112 to dig in or be stopped by irregularities in the surface.

Figure 4:
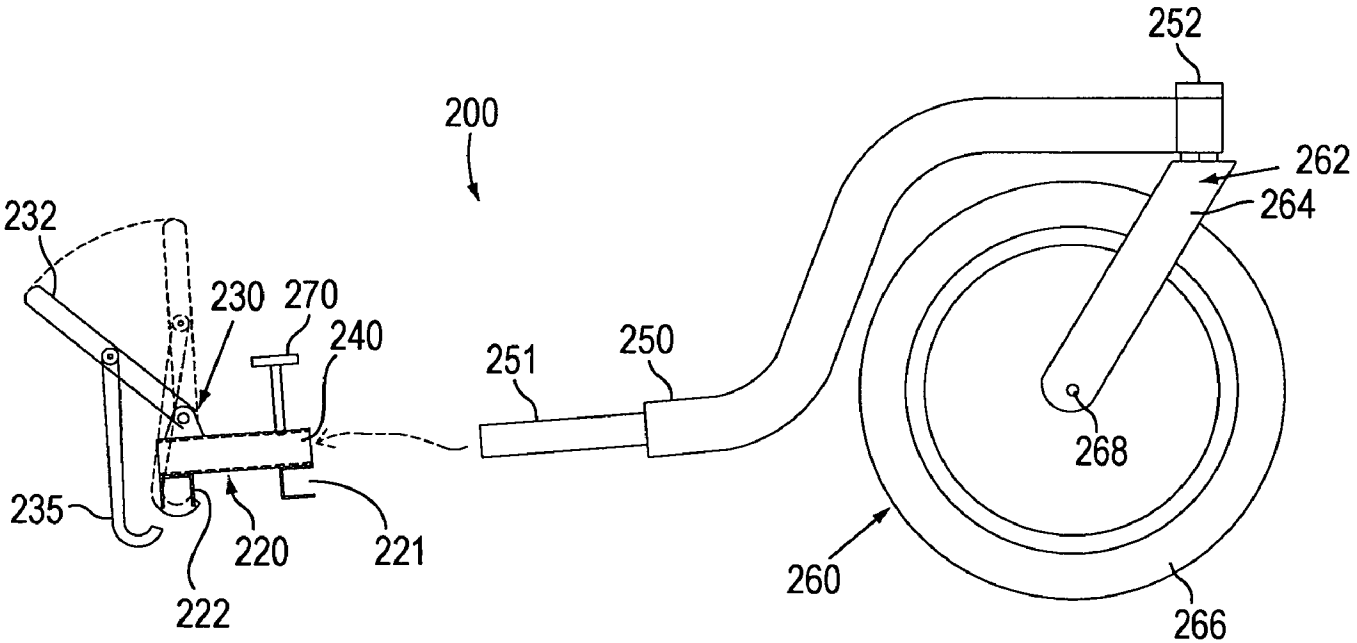
FIGS. 4 and 5 are vertical side views that illustrate an all terrain wheelchair adapter of a second embodiment of the present invention and its method of attachment to a wheelchair.
Figure 5:
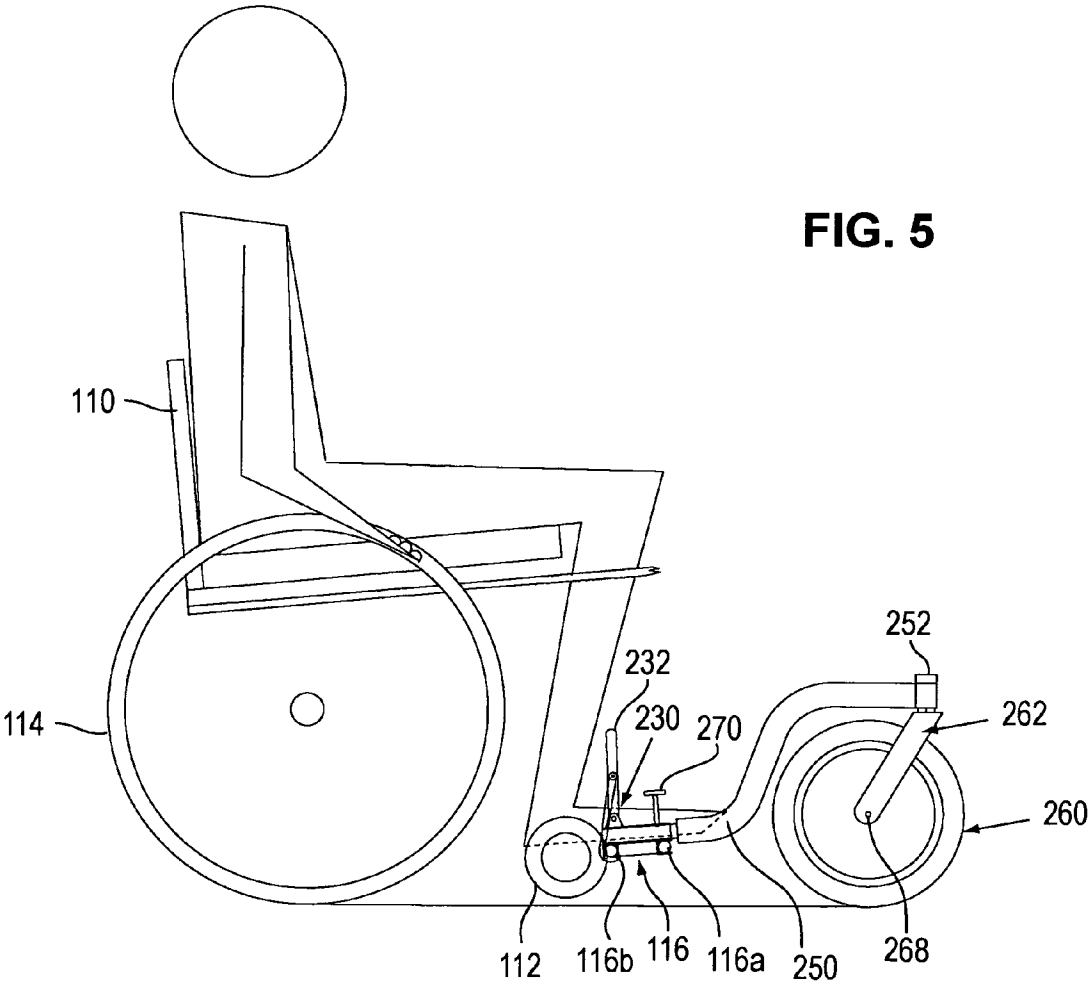

Referring now to FIGS. 4 and 5, an adapter 200 according to a second embodiment of the invention comprises a fixture 220 mounted to the wheelchair foot support 116 by any means, such as a clamp 230 or with bolts. In the preferred embodiment, the fixture 220 is equipped on its forward, underside edge with a forwardly facing channel member 221. It is also equipped on its rearward, underside edge with a downwardly facing channel member 222. During installation, the fixture 220 is installed with the member 221 engaged with the front bar 116*a* of the foot support 116 and, as the fixture 220 is rotated counterclockwise (as viewed in FIG. 4), the member 222 engages the rear bar 116*b* of the foot support 116. The clamp handle 232 is then moved to its closed position, causing the clamp's hook 235 to clamp the rear bar 116*b* in the member 222. The fixture 220 can be left on whether or not the adapter is being used. The fixture 220 includes a socket type fitting 240 similar in concept to that used with a trailer ball hitch. An "S" shaped support 250 has one end 251 that snugly fits into the socket 240. It should be understood that, alternatively, the fixture 220 could have a protrusion that snugly fits in a socket on the end of the support 250. A screw stem 270 in the fixture 220 over the socket 240 can be tightened to hold the support end 251 in the socket 240.

A nose gear wheel 260 assembly, similar in construction to the nose gear wheel assembly 160, is located at the other end of the support 250. The nose gear wheel assembly 260 has wheel 266 with a diameter (10" to 16" and preferably about 12") much larger that the diameters of the front wheels 112 and is large enough to roll over holes, obstacles, or soft surfaces that can be expected to be encountered when traveling off of normal, smooth, hard terrain. The nose gear wheel 266 is mounted between the parallel legs 264 of a fork 262 that is swivel mounted 252 to the free end of the support 250. The legs 264 are canted at about 27° from the vertical so as to slope back toward the front wheels 112 from the top of the fork 262 to produce a positive trail of about 3". In this way, the nose gear wheel 260 swivels in such a manner that, when the wheelchair 110 is moving forward, the top of the fork 262 is adjacent to the leading edge of the nose gear wheel 260. Additionally, the swivel mounting 252 of the support 250 is slightly inclined backward from the vertical, as in the first embodiment of the invention, to have the caster angle α.

In operation, the user slightly elevates the front wheels 112 by either rolling the front wheels 112 up onto something like a door jamb, etc. or just popping a wheelie and having someone else carefully insert the support 250 into the fitting socket 240. The nose gear wheel 260 is preferably turned so that the fork 264 is in the rearward traveling position (as shown in FIG. 2). The thumbscrew 270 in the fixture 220 over the socket 240 is tightened to hold the end of the support 250 in the socket 240. The wheelchair user then rolls the wheelchair forward until the nose gear wheel rotates 180°, thereby shortening the wheelbase with the result that the front wheels 112 are thereafter lifted and suspended in air, in a manner similar to that described in regard to the first embodiment. As shown in FIG. 5, the adapter 200 is now the only operative front wheel of the wheelchair 110. When the wheelchair 110 is propelled forward, the nose gear wheel 260 rides up and over obstacles or soft surfaces without throwing the wheelchair off balance.

In a less advantageous modification of this embodiment, the swivel mounting 252 of the support 250 is not inclined backward from the vertical and does not have the caster angle α. In this modified embodiment, the support 250 is shaped so that when it has one end securely mounted in the fitting socket 240, the nose gear wheel 260 holds the front wheels 112 clear of the ground. In this embodiment it is not necessary to roll the wheelchair 110 forward to lift the front wheels 112 off of the ground.

It should be apparent that the fixtures 120 and 220 can be modified so that the adapter will fit multiple designs of wheelchair foot supports. Also, the caster angle of the steering stem can be modified so that the amount of distance that the wheelchair front wheels are lifted off the ground can be adjusted. For example, for every 5 degrees of caster angle α of the steering stem (152, 252), the wheelchair front wheels 112 are lifted a half inch off the ground when the nose gear wheel 166, 266 is rotated from the backward rolling position to the forward rolling position.

Figure 6:
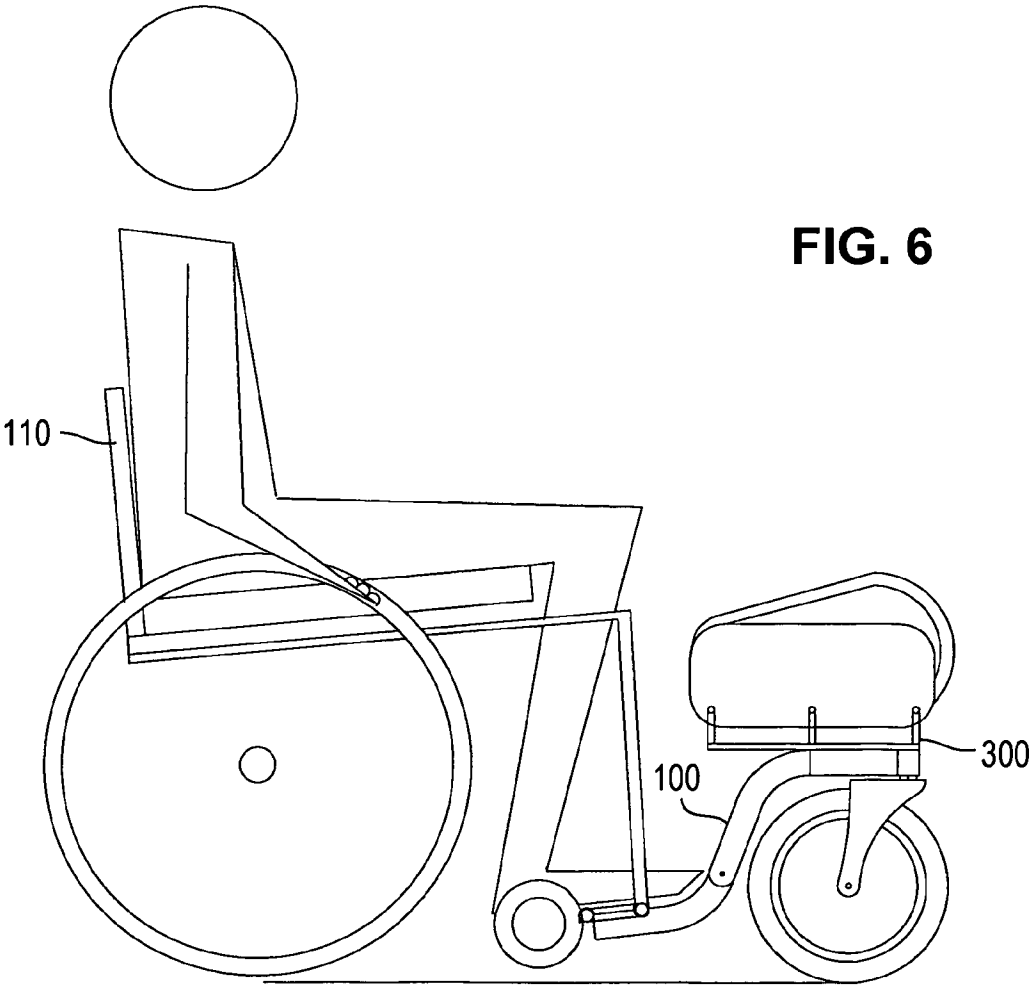
FIGS. 6-9, inclusive, are vertical side views illustrating various attachments to the all terrain adapter according to different embodiments of the invention.
Figure 7:
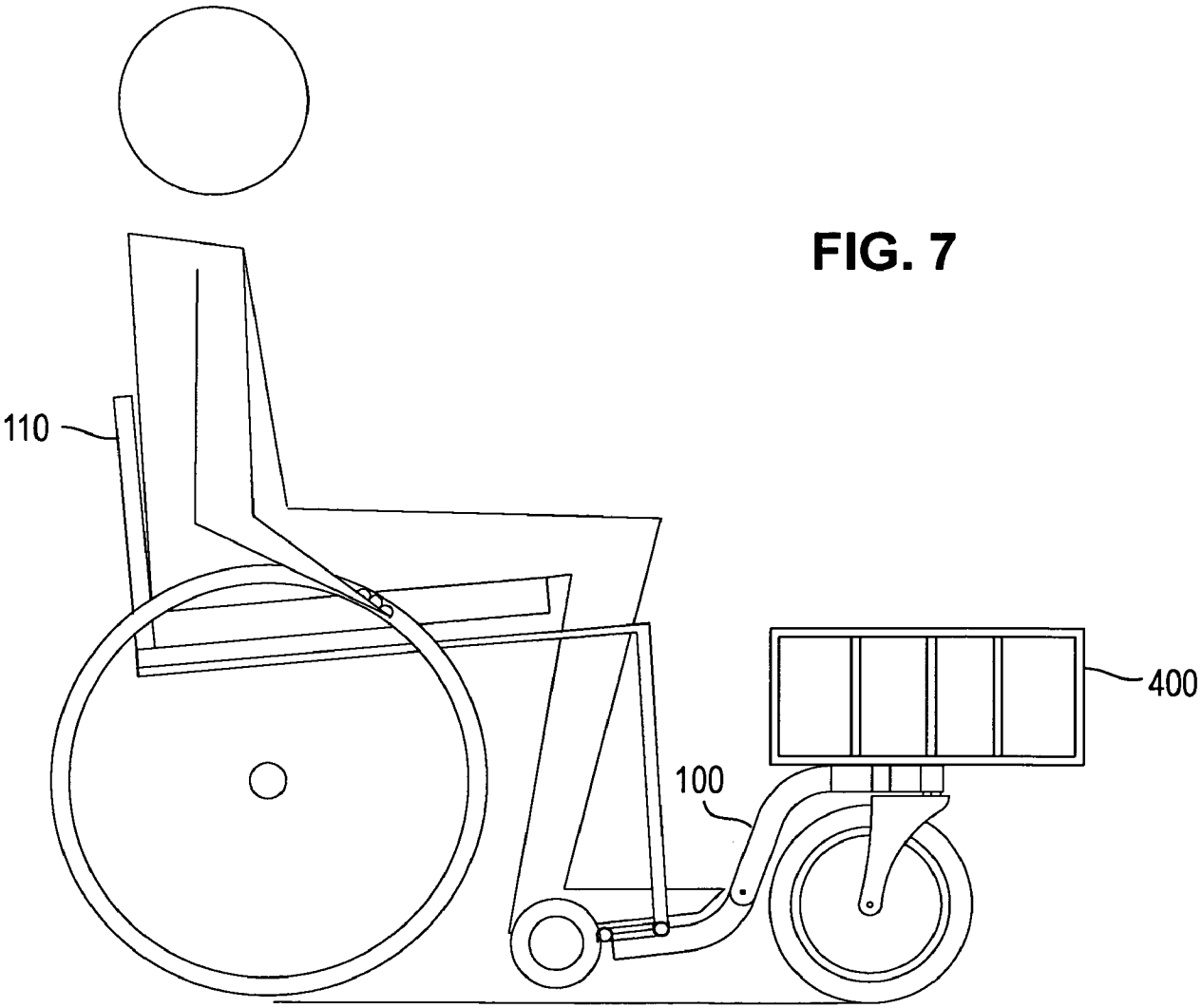
Figure 8:
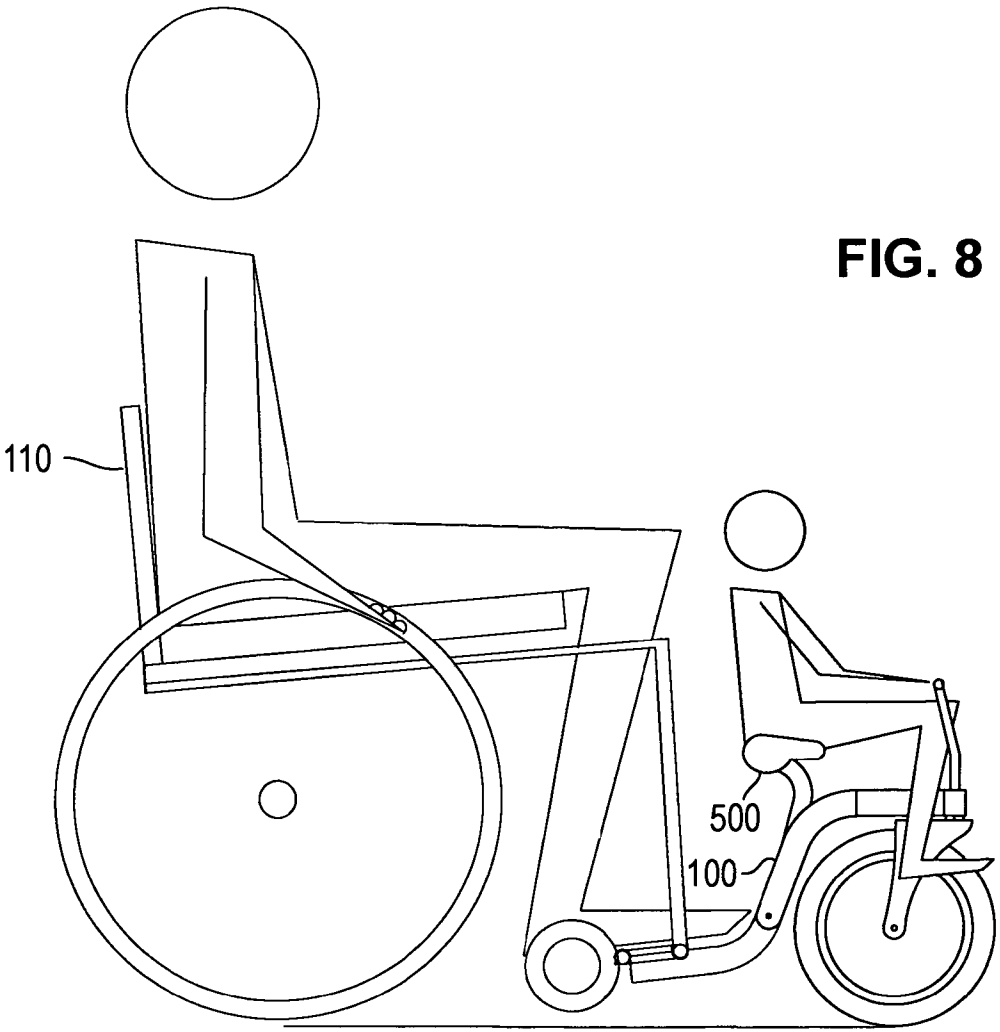
Figure 9:
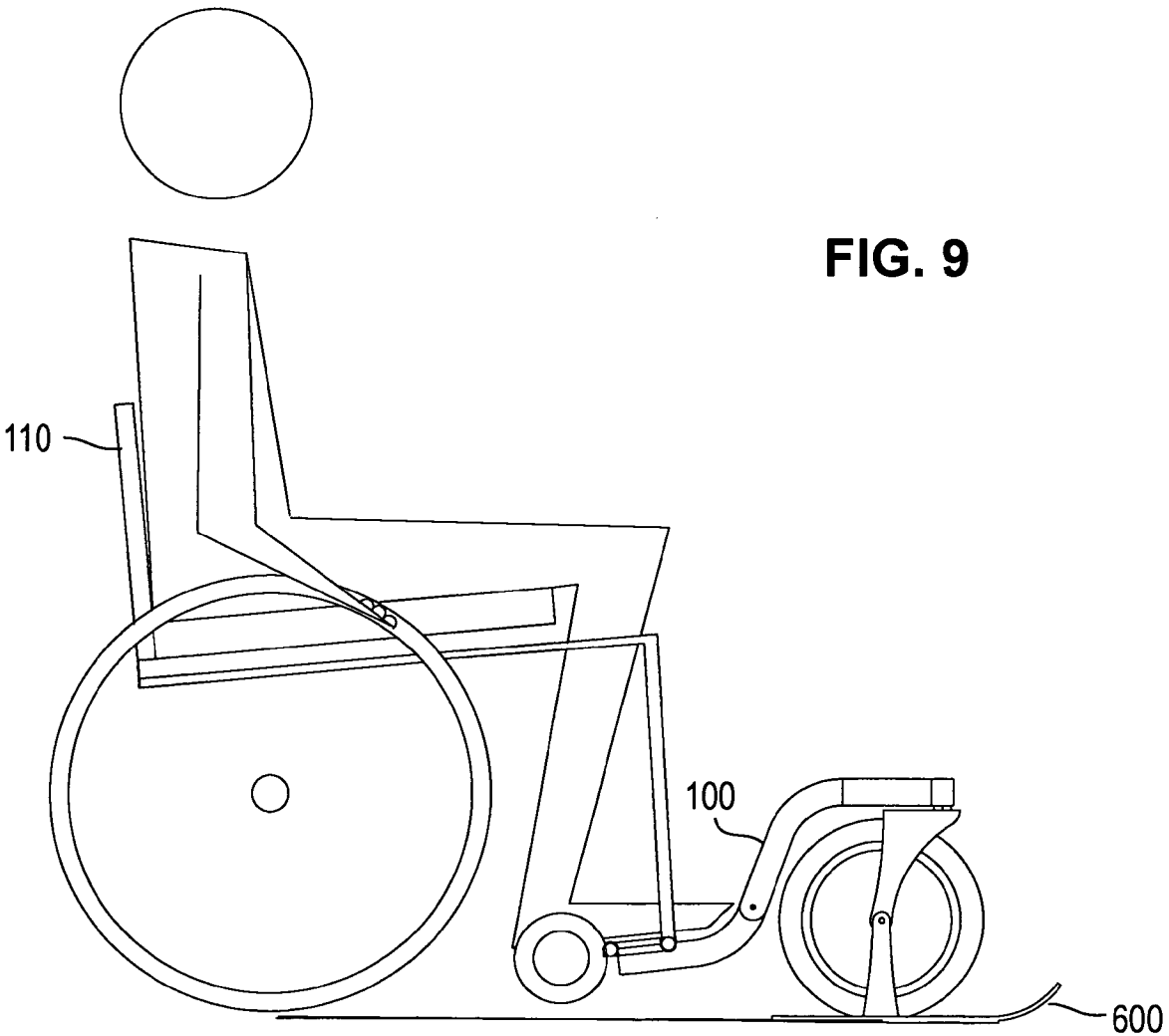

Referring now more particularly to FIGS. 6-8, inclusive, various modifications are disclosed to enable carrying of loads on the all terrain adapter according to the invention. When pushing a wheelchair one needs both arms and to balance anything in the lap often results in dropping of the load. Mounting a rack 300 (FIG. 6) or a box 400 (FIG. 7) on the adapter 100 or 200 allows the user to push with confidence because the load is secure on the adapter. Other accessories can include a child seat 500 (FIG. 8) and foot pegs so that the user can take a small child for a ride. Referring to FIG. 9, still another accessory includes a ski fitting 600 that mounts to the axle 168 or 268 of the nose gear wheel 166 or 266 of the adapter 100 or 200, respectively. This adds surface area to the ground to keep the nose gear wheel from sinking into very soft surfaces like snow or grass or sand.

Although the present invention has been described with reference to specific exemplary embodiments, it will be evident that various modifications and changes may be made to these embodiments without departing from the broader spirit and scope of the invention as set forth in the claims. Accordingly, the specification and drawings are to be regarded in an illustrative rather than a restrictive sense.

What is claimed is:

1. An all-terrain adapter for a wheelchair of the type having a seat frame, including a foot support, and large rear wheels and smaller front wheels mounted to the seat frame for allowing the wheelchair to be rolled over a surface, the adapter comprising:

a strut for removable attachment at one end to the foot support;

a single nose gear wheel having a diameter that is at least ten inches;

a swivel mount for attaching the nose gear wheel to another end of the strut so that the nose gear wheel swivels about an axis that is slightly inclined from the vertical;

attachment means for attaching and detaching the one end of the strut to the foot support; and wherein the front wheels of the wheelchair are lifted from the ground and remain suspended above the ground by the action of propelling the wheelchair in the forward direction to cause the nose gear wheel to swivel in a direction that shortens the wheelbase of the wheelchair between the nose gear wheel and the rear wheels.

2. An all-terrain adapter for a wheelchair as recited in claim 1, wherein the attachment means includes a hand-operated clamp for clamping the one end of the strut to the foot support.

3. An all-terrain adapter for a wheelchair as recited in claim 2, wherein the hand-operated clamp, in clamping the one end of the strut to the foot support, forces the other end of the strut, on which the nose gear wheel is mounted, downward to bring the nose gear wheel in contact with the ground until the foot support and wheelchair are tilted backward, thereby relieving some of the weight of the wheelchair from the front wheels.

4. An all-terrain adapter for a wheelchair as recited in claim 1, further comprising a male coupling and a female coupling that attaches the strut to the attachment means.

5. An all-terrain adapter for a wheelchair as recited in claim 1, wherein the wheelchair further includes a foot support having a pair of parallel, horizontal bars and the attachment means includes coupling members for engaging each of the bars and a clamp for clamping at least one of the bars onto one of the coupling members.

6. An all-terrain adapter for a wheelchair as recited in claim 1, wherein the swivel mount includes wheel fork having a pair of canted legs that straddle and rotatably support the nose gear wheel and produce a horizontal trail and wherein the wheel fork rotates about the axis that is inclined from the vertical.

7. An all-terrain adapter for a wheelchair as recited in claim 1, wherein the strut is generally "S" shaped.

8. An all-terrain adapter for a wheelchair as recited in claim 1, wherein the attachment means pivots in a vertical plane between a stowed position, wherein the nose gear wheel is lifted from the ground, and an operative position, wherein the nose gear wheel is in contact with the ground and further including a locking mechanism for locking the attachment means in each of the stowed position and the operative position.

9. An all-terrain adapter for a wheelchair of the type having a frame, and large rear wheels and smaller front wheels mounted to the frame for allowing the wheelchair to be rolled over the ground, wherein the adapter comprises:

a fixture clamped to the wheelchair frame;

a strut extending at one end from the fixture toward the forward direction of travel of the wheelchair;

a nose gear wheel assembly including a wheel having a diameter that is at least ten inches and a fork for straddling and rotatably mounting the wheel, the fork having a steering column and a pair of canted legs joined at one end to the steering column so that the wheel has a mechanical trail;

a swivel mount for attaching the steering column to another end of the strut at a caster angle; and wherein the front wheels of the wheelchair are lifted from the ground and remain suspended above the ground by the action of propelling the wheelchair in the forward direction to cause the nose gear wheel to swivel in a direction that shortens the wheelbase of the wheelchair between the nose gear wheel and the rear wheels.

10. An all-terrain adapter for a wheelchair as recited in claim 9, wherein the fixture includes a hand operated clamp.

11. An all-terrain adapter for a wheelchair as recited in claim 10, wherein the clamp is a vertical pull action latch clamp.

12. An all-terrain adapter for a wheelchair as recited in claim 9, wherein the fixture further comprises a male coupling and a female coupling that attaches the strut to the fixture.

13. An all-terrain adapter for a wheelchair as recited in claim 9, wherein the wheelchair frame includes a foot support having a pair of parallel, horizontal bars and the fixture includes coupling members for engaging each of the bars and a clamp for clamping at least one of the bars onto one of the coupling members.

14. An all-terrain adapter for a wheelchair as recited in claim 9, wherein the strut is generally "S" shaped.

15. An all-terrain adapter for a wheelchair as recited in claim 9, wherein the adapter pivots in a vertical plane between a stowed position, wherein the nose gear wheel is lifted from the ground, and an operative position, wherein the nose gear wheel is in contact with the ground and further including a locking mechanism for locking the adapter in each of the stowed position and the operative position.

16. An all-terrain adapter for a wheelchair as recited in claim 1, wherein the swivel mount includes wheel support having at least one canted leg that rotatably supports the nose gear wheel and produces a horizontal trail and wherein the wheel support rotates about the axis that is inclined from the vertical, the top of this axis being inclined from the vertical toward the rear of the wheelchair.

17. An all-terrain adapter for a wheelchair as recited in claim 1, wherein the top of the axis about which nose gear wheel swivels is inclined from the vertical toward the rear of the wheelchair.

18. An all-terrain adapter for a wheelchair as recited in claim 9, wherein the caster angle is such that the steering column swivels about an axis the top of which is inclined from the vertical toward the rear of the wheelchair.

* * * * *